United States Patent [19]

Love

[11] Patent Number: 5,056,191

[45] Date of Patent: Oct. 15, 1991

[54] BUTT HINGE PAINT MASK AND MASKING METHOD

[76] Inventor: Fred Love, 7119 University Blvd., Winter Park, Fla. 32792

[21] Appl. No.: 574,200

[22] Filed: Aug. 28, 1990

[51] Int. Cl.[5] ..... E05D 11/00

[52] U.S. Cl. ..... 16/251; 16/250; 118/505

[58] Field of Search ..... 16/250, 251; 118/504, 118/505

[56] References Cited

U.S. PATENT DOCUMENTS

| | | | |
|---|---|---|---|
| 1,843,432 | 2/1932 | Nickerson . | |
| 2,045,597 | 6/1936 | Haug | 118/505 |
| 3,961,602 | 6/1976 | Dresser | 118/505 |
| 4,195,590 | 4/1980 | Herrington | 118/505 |
| 4,420,520 | 12/1983 | Jones et al. | 428/42 |
| 4,691,409 | 9/1987 | Torgerson et al. | 16/250 |
| 4,713,274 | 12/1987 | Minor | 428/40 |
| 4,795,669 | 1/1989 | Bowskill et al. | 428/194 |
| 4,796,330 | 1/1989 | Ziegler | 16/251 |
| 4,802,259 | 2/1989 | Geslewitz | 16/251 |

*Primary Examiner*—Richard K. Seidel
*Assistant Examiner*—Patty E. Hong
*Attorney, Agent, or Firm*—Warren L. Franz

[57] ABSTRACT

A paint mask for a butt hinge and a masking method for protecting the hinge against paint spray or the like. The hinge paint mask includes a rectangular main portion sized to match and cover the front faces of the hinge leaves and the front of the barrel. The mask also includes central, respectively upwardly and downwardly projecting tab portions sized to fold over all parts of the upper and lower edges of the leaves adjacent the hinge barrel which are not shielded by the door edge or jamb recesses.

12 Claims, 2 Drawing Sheets

BUTT HINGE PAINT MASK AND MASKING METHOD

This invention relates to butt hinges used to hang doors from door jambs; and, in particular to an improved paint mask and masking method for protecting such a butt hinge against paint spray or the like.

BACKGROUND OF THE INVENTION

A conventional butt hinge for hanging a door from a door framework or jamb has two flat rectangular leaf portions or plates joined in pivotal side-by-side relationship by a pin or pintle inserted up to a head into a central bore of a barrel defined by vertically aligned, interdigitated knuckles or barrel portions which are spaced along adjacent vertical edges of the leaves. One leaf is attached at a recess formed in an edge of the door; the other leaf is attached at a recess formed in an adjacent confronting position on the jamb. The leaves are placed so that they meet and butt together when the door is closed to bring the door edge into contact with the jamb. The recesses act to conceal opposite vertical edges of the leaves, as well as a majority of their back faces and upper and lower horizontal edges. Approximately one-quarter of each leaf portion in a region near the barrel (including parts of the back face and upper and lower edges) sticks out of the associated recess.

When a door is painted, and especially when it is spray painted, it is desirable to protect the butt hinge from paint by applying a covering tape or similar paint masking material. The exposed portions of the hinge to be covered are those that are not concealed within the door edge and jamb recesses The exposed surfaces are the entire front faces of the leaves, the top of the pin, all of the barrel, and those parts of the back faces and upper and lower edges of the leaves that are not protected by the recesses It is difficult to tear or cut out pieces of masking tape to obtain just the right coverage of the exposed hinge surfaces. If too much tape is applied, areas which should be painted are missed; if too little is applied, paint gets on the hinge. One time consuming alternative to masking is to avoid getting paint on the hinges by carefully painting around them. Another, labor intensive, approach is to take off the hinges completely after removing the door from the jamb.

Preconfigured butt hinge paint masks exist but are inadequate. Examples of such masks are shown in U.S. Pat. Nos. 3,961,602; 4,195,590; 4,691,409; and 4,796,330. Desirable objectives for any butt hinge paint mask are that it be inexpensive, be able to be quickly and readily applied, afford complete matching coverage to shield all exposed surfaces, and be usable with only minimum interference with normal operation of the hung door.

The '602, '590 and '330 masks are flexible members that have pressure sensitive adhesive coatings and are preshaped to be applied over exposed parts of the hinge. The '602 and '590 masks are applied with the door removed from the jamb. The '602 and '590 masks are configured with a rectangular leaf covering portion and an associated adjacent barrel covering portion, dimensioned to cover the exposed front face of one leaf and the exposed cylindrical face of the barrel knuckles of one half of the hinge. Those masks are not dimensioned to cover the front and back faces of the full hinge in its assembled position, with the door attached to the jamb. Those masks also provide no coverage for the parts of the top and bottom edges of the leaves that are outside the door and jamb recesses, nor for the top and bottom surfaces of the pin and barrel.

The '330 device is applied with the door still in its operable attached position. The '330 mask consists of two monolithic parts, one of which is configured to provide full coverage of the front faces of the leaves and barrel of the assembled hinge, and the other of which is configured to cover the exposed parts of the back faces of the leaves and barrel. Though an upwardly extending tab is provided centrally in line with the top of the barrel, that tab is merely intended to serve as a finger grip for removal of the mask and not as a cover for the upper surfaces of the barrel or top of the pin, and the tab is not wide enough to cover the exposed top edge surfaces of the leaves. Also, the '330 mask makes no provision for coverage of any exposed hinge bottom surfaces Moreover, although the part of the '330 mask that covers the back surface of the leaves and barrel can be applied with the door attached to the jamb, its monolithic characteristic will cause it to distort or separate from its adhered position after application, if the door is operated in the normal manner with the mask applied.

The '409 mask comprises an elastic body that is stretched over the hinge barrel. The '409 structure is expensive, cumbersome to install, and covers only the front, back and lower surfaces of the assembled barrel.

SUMMARY OF THE INVENTION

It is an object of the present invention to provide an improved inexpensive paint mask which is presized to cover all exposed surfaces of a conventional butt hinge and which can be readily installed over the attached hinge of an operable door.

It is another object of the present invention to provide an improved method of masking a conventional door butt hinge using the improved mask of the invention.

In accordance with one aspect of the invention, a butt hinge paint mask includes a rectangular main portion sized to match and cover the front faces of the hinge leaves and the front of the barrel The mask also includes central, respectively upwardly and downwardly projecting tab portions sized to fold over those parts of the upper and lower edges of the leaves adjacent the hinge barrel which are not shielded by the door edge or jamb recesses In another aspect of the invention, the paint mask is made separable by score lines to provide left and right wing subportions which can be overlapped to cover the back faces of the leaves and back of the barrel, and upper and lower central subportions for covering the top of the inserted pin and bottom of the barrel.

In the method of the invention, one unseparated mask is used to cover the front of the hinge, with the tabs overlapping exposed upper and lower edge surfaces of the leaves; and another mask, separated into subportions, is used to cover the exposed back faces of the leaves and top and bottom of the barrel and pin. The two part coverage of the back faces provided by overlapping left and right separated subportions, builds sufficient slack into the applied masking to enable the door to be operated in the normal manner without attaching the hinge mask.

In a preferred embodiment of the invention, a plurality of sheets of the mask is provided in the form of a pad.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
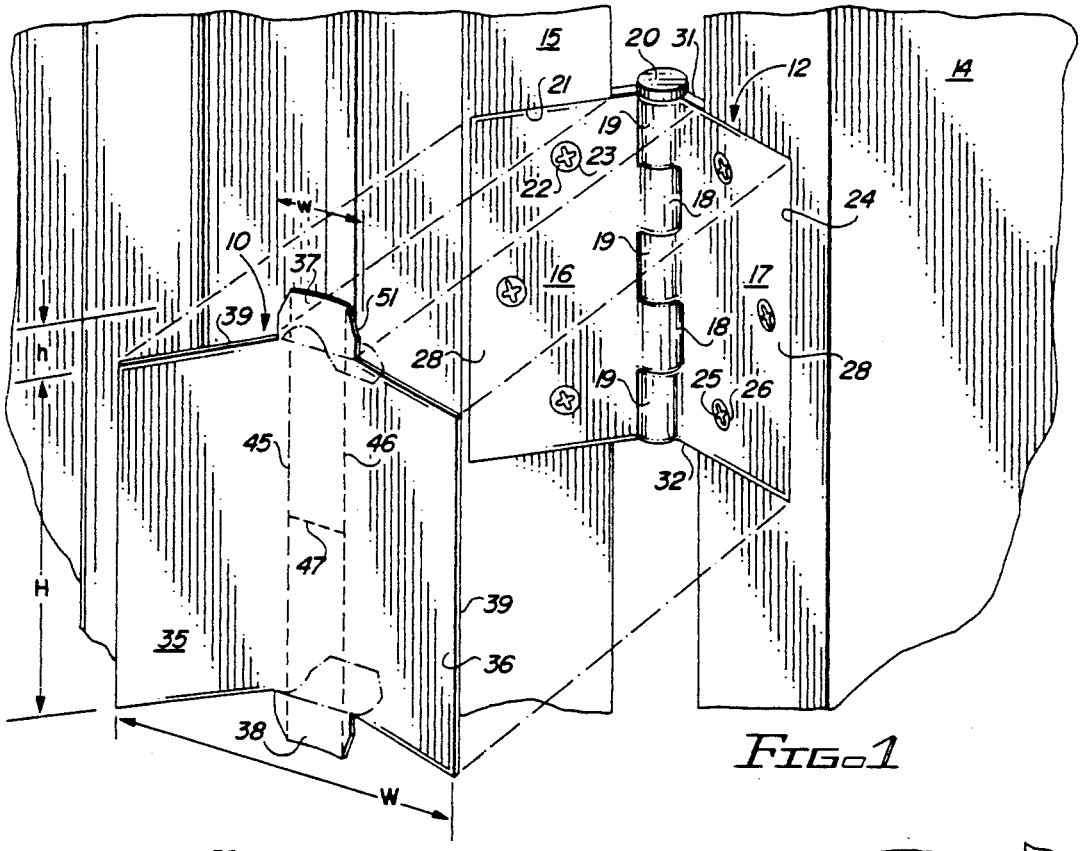
FIG. 1 is a perspective view of a butt hinge paint mask in accordance with an embodiment of the invention, shown in use for placement in protective position over a conventional door butt hinge.
Figure 2:
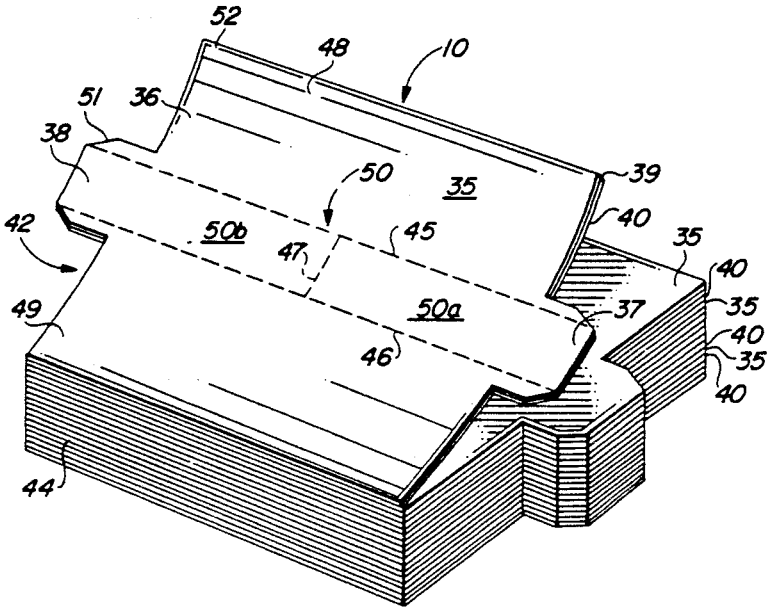
FIG. 2 is a perspective view of a pad of masks as in FIG. 1.
Figure 3A:
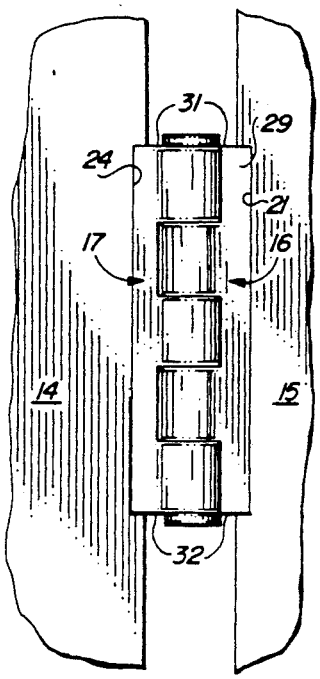
FIGS. 3A–3F are views showing the use of the mask of FIGS. 1 and 2 employed in masking the hinge in accordance with an embodiment of the masking method of the invention.

FIGS. 1–2 show a paint mask 10 in accordance with the invention, for protecting a conventional butt hinge 12 used to hang a door 14 on a door jamb 15. The hinge 12 includes two flat rectangular leaf portions 16, 17 joined in pivotal side-by-side relationship at vertically aligned, interdigitated barrel portions 18, 19 by a pin 20 inserted up to a head into a central bore of a barrel defined by the barrel portions 18, 19. One leaf 16 is attached within a recess 21 formed on the jamb 15 by means of screws 22 which pass through apertures 23 formed in the leaf 16. The other leaf 17 is attached within a recess 24 formed on the confronting edge of the door 14 by means of screws 25 that pass through apertures 26. The leaves 16, 17 of the assembled hinge 12 have as exposed surfaces the front faces 28 (FIGS. 1 and 3D), parts of back faces 29 not within recesses 21, 24 (FIG. 3A), and parts of upper and lower edges 31, 32 not within recesses 21, 24 (FIGS. 1 and 3A).

The mask 10 (see FIGS. 1 and 2) comprises a thin flat flexible body member 35 having a generally rectangular main portion 36 and central tab portions 37, 38, projecting respectively upwardly and downwardly from the main portion 36 (as shown in FIG. 1). A coating of pressure sensitive adhesive 39 (FIG. 2) is evenly applied, completely over a back surface of the body member 35. A protective backing sheet 40 (FIG. 2) is disposed in juxtaposition with the adhesive coating 39 on the back surface of the body member to protect the adhesive coating until use.

The rectangular region 36 of the member 35 is shaped to match and cover the combined contour of the front faces 28 of the leaves 16, 17 and the front of the barrel of the assembled hinge 12, with the door mounted and brought into an open position so that the leaf 16 is in general coplanar alignment with the leaf 17, as shown in FIG. 1. The tab portions 37, 38 are dimensioned, configured and adapted to be folded over (from the solid to the dot-dashed positions in FIG. 1), when the main portion is matched to the front faces 28 and front of the barrel portions 18, 19, to cover the exposed upper and lower edge surfaces 31, 32.

The adhesive 39 applied to the back surface of the mask body 35 is chosen to adhere the mask 10 over the hinge 12 in a subsequently removable way. The backing sheet 40 is of a material which can be readily peeled from the adhesive coating 39 to expose the coating preparatory to use. FIG. 1 shows the mask 10 with the sheet 40 removed.

In a preferred configuration, a plurality of masks 10 are brought into superposed positions and secured together at one end 44 by application of an adhesive or other suitable means.

In accordance with a feature of the invention, the body 35 is made separable into subparts by kiss score lines 45, 46, 47 indicated by dashed lines in FIGS. 1 and 2. Score lines 45, 46 are made parallel to the opposite vertical side edges as seen in FIG. 1) of the body 35 at points to define leaf back face covering subregions 48, 49 that include respective left and right wings of the rectangular region 36, and approximately one-sixth of the tabs 37, 38. Score line 47 is made horizontally between the lines 45, 46 to divide a remaining elongated portion 50 (FIG. 2) into upper and lower rectangular subregions **50*a* and 50*b*. The corners of the tabs 37, 38 are angled at 51 between the outside edges of the tabs and the score lines 45, 46. The corners 52 of the main portion 36 are squared or rounded to match the corresponding corners of the butt hinge 12**.

Conventional butt hinges used to hang normal-sized doors (i.e., building doors as opposed to cabinet doors) come in standard 3", 3½" and 4" sizes, with rounded or squared corners. The particular size, weight and number of hinges used depends on the weight and thickness of the door. For use with a standard 3½"×3½" butt hinge, for example, the mask 10 may suitably have a height H=3½", width W=3½", and tab portions 37, 38 of height h=½" and width w=1½" (see FIG. 1). The tab corners 51 may be cut diagonally, removing ⅜" of height h and ¼" of width w at each corner. The lines 45, 46 are made to coincide with the uncut upper and lower extremes of the tabs 37, 38, i.e. they are respectively made ¼" in from the left and right sides of the tabs 37, 38. The score line 47 is made horizontally at the mid-height of the region 36. The body member 35 may be suitably made from Scotch Mark TM 7116 or 7600 vinyl label stock or any of a number of other commercially available lightweight, flexible facestock materials that allow conformability to irregular or curved surfaces and provide good moisture resistance. The adhesive 39 may be 3M's Post-it TM brand or similar removable adhesive. The backing 40 may be a glassine kraft or other known peelable adhesive backing material.

In use, a first mask unit 10 taken from the pad 42 is separated into its constituent subparts **48, 49, 50*a* and 50*b* along the score lines 45, 46 and 47. The door 14 is closed sufficiently to make accessible the unconcealed parts of the back faces 29 (FIG. 3A) of the leaves 16, 17 and the back of the barrel comprised of the aligned barrel portions 18, 19. The backing sheet 40 is removed to expose the adhesive coating 39, and the score line edge 46 of a first subpart 49 is aligned with the door 14, as shown in FIG. 3B. The adhesive is pressed against the hinge 12 at the exposed back face part of the leaf 17, and the opposite wing edge of the subpart 49 is left unattached to project outwardly from behind the barrel. The other subpart 48 is then applied in like manner to the exposed back face part of the hinge leaf 16. The tab portions 37*a*, 38*a* of each subpart 48, 49 are folded over the exposed upper and lower edge surfaces 31, 32 respectively located adjacent the door 14 and jamb 15, as shown. The free unattached wing edges of the subparts 48, 49** are then pressed together to give a ducktail-like pinched appearance, as shown in FIG. 3C.

Figure 3E:
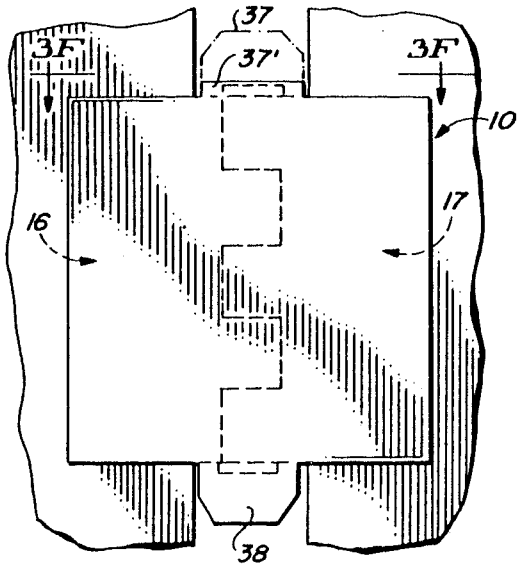
Figure 3F:
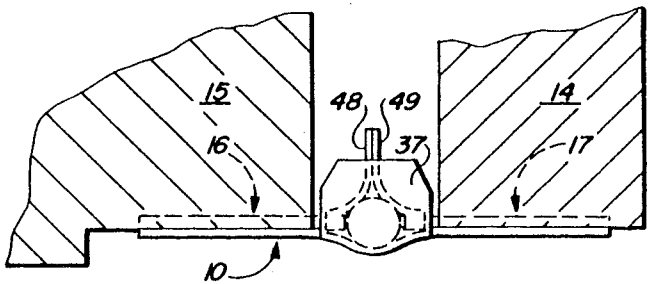
Figure 3D:
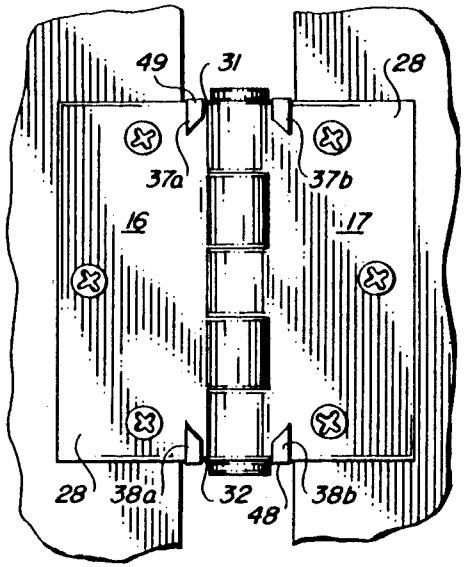
Figure 3C:
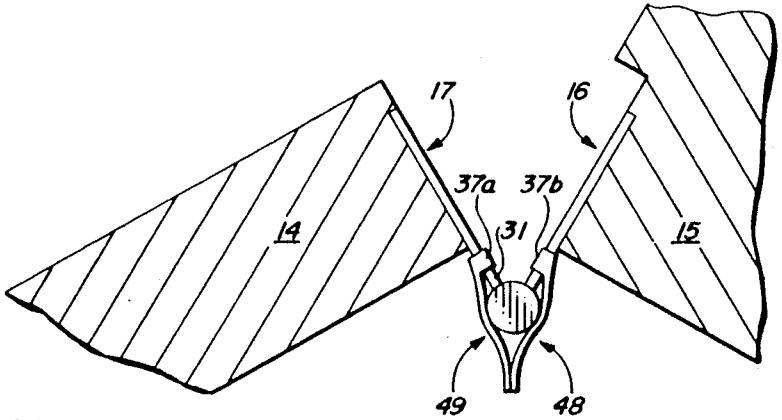
Figure 3B:
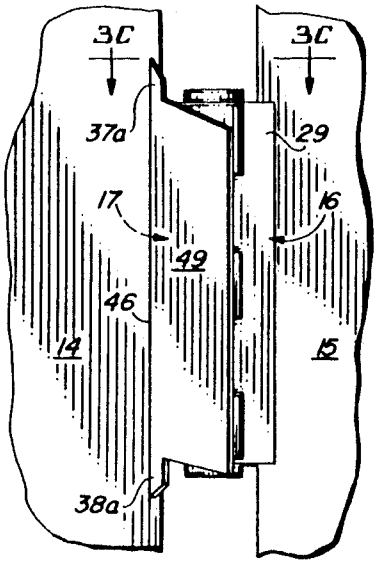

Next, as seen in FIGS. 3D-3F, the door is opened and another mask unit 10 is peeled from the pad 42 to be applied over the front faces of the leaves 16, 17 and the front of the barrel portions 18, 19. After removal of the sheet 40, The member 35 is aligned with the hinge 12 as shown in FIG. 1, then superposed thereon with the adhesive coating 39 pressed against the hinge 22, as shown in FIG. 3E. The upper and lower tab portions 37, 38 are folded over the exposed upper edge surfaces 31, 32 of the leaves 16, 17 and also over the tops of the pin 20 and barrel (indicated in FIG. 3E for the top tab, by movement from the dot-dash position 37 to the solid line position 37'). This folding brings the tabs 37, 38 also and over the forwardly directed folds **37*a*, 37*b*, 38*a*, 38*b* of the first applied unit 10. The resulting masked configuration is shown in FIG. 3F. The remaining subportions 50*a*, 50*b* of the first mask 10 may then optionally be applied between the folded tabs 37, 38 and the ducktail-joined edges of the subportions 48, 49** to complete the coverage of the top of the pin and top and bottom of the barrel.

With the two mask units 10 thus applied, the attached hinge 12 has no uncovered, exposed surfaces. The first unit 10 covers the unconcealed parts of the back faces 29 of the leaves 16, 17 and the backs of the barrel portions 18, 19. The second unit 10 covers the front faces 28 and unconcealed parts of the upper and lower edges 31, 32 of the leaves 16, as well as the fronts of the barrel portions 18, 19. The subportions **50*a*, 50*b* of the first unit 10 cooperate with the tabs 37, 38 of the second unit 10 to cover the top of the pin and top and bottom of the barrel. The pinched or ducktailed arrangement of the two parts 48, 49 permits the door to be swung open and closed, without detaching or dysfunctionally deforming the parts 48, 49**.

In this manner, the present invention provides an inexpensive mask which can be quickly and easily applied to a conventional butt hinge mounting a door to a door jamb, with complete coverage of all exposed surfaces and which remains in place without interference during normal door opening and closing operations.

Those skilled in the art to which the invention relates will appreciate that other substitutions and modifications can be made to the described embodiment without departing from the spirit and scope of the invention as described by the claims below.

What is claimed is:

1. A mask for protecting a butt hinge hanging a door on a joint; said hinge comprising first and second flat rectangular leaf portions having upper, lower and side edges and front and rear faces; barrel portions spaced along adjacent ones of said side edges and brought into vertically aligned interdigitated positions to define a barrel having a front, a back, a top and a bottom and including a central bore therethrough; and a pin having a head with a top and inserted into said bore up to said head to join said leaf portions at said barrel in pivotal side-by-side relationship; said first leaf portion being attached within a recess formed on said door and said second leaf portion being attached within a recess formed on said joint; said recesses acting to cover opposite ones of said side edges and parts of said upper and lower edges and said rear faces; and said mask comprising:

a thin flexible body member having a front surface and a back surface;

a coating of pressure sensitive adhesive applied to said back surface of said body member; and a protective backing sheet disposed in juxtaposition with the adhesive coating on said back surface to protect the adhesive coating while being readily peelable therefrom to expose the adhesive coating preparatory to use of said body member;

said body member including a generally rectangular main portion dimensioned, configured and adapted to match and cover the contour of said front faces of said leaf portions and said front of said barrel when said door is brought into position with said first and second leaf portions in coplanar alignment; and central tab portions, extending respectively upwardly and downwardly from said main portion, and being dimensioned, configured and adapted to be folded over when said main portion is matched to said front faces and said front, to cover exposed parts of said upper and lower edges not covered by said recesses; said body member further including vertical kiss score lines for separating said body member into first and second subregions respectively including left and right wing subportions of said main portion.

2. A mask as in claim 1, wherein said score lines are positioned for separating said body member also into a third subregion located intermediate said first and second subregions; said first and second subregions respectively further including left and right subportions of said tab portions, and said third subregion including central subportions of both said main portion and said tab portions.

3. A mask as in claim 2, wherein said body member further includes a horizontal kiss score line for separating said third subregion into upper and lower pieces.

4. In combination with a door, a door join, and a butt hinge ganging said door on said joint, a mask for protecting the hinge; said hinge comprising first and second flat rectangular leaf portions having upper, lower and side edges and front and rear faces; barrel portions spaced along adjacent ones of said side edges and brought into vertically aligned interdigitated positions to define a barrel having a front, a back, a top and a bottom and including a central bore therethrough; and a pin having a head with a top and inserted into said bore up to said head to join said leaf portions at said barrel in pivotal side-by-side relationship; said first leaf portion being attached within a recess formed on said door and said second leaf portion being attached within a recess formed on said joint; said recesses acting to cover opposite ones of said side edges and parts of said upper and lower edges and said rear faces; and said mask comprising:

a thin flexible body member having a front surface and a back surface;

a coating of pressure sensitive adhesive applied to said back surface of said body member; and a protective backing sheet disposed in juxtaposition with the adhesive coating on said back surface to protect the adhesive coating while being readily peelable therefrom to expose the adhesive coating preparatory to use of said body member;

said body member including a generally rectangular main portion dimensioned, configured and adapted to match and cover the contour of said front faces of said leaf portions and said front of said barrel when said door is brought into position with said first and second leaf portions in coplanar alignment; and central tab portions, extending respectively upwardly and downwardly from said main portion, and being dimensioned, configured and adapted to be folded over when said main portion is matched to said front faces and said front, to cover all exposed parts of said upper and lower edges not covered by said recesses.

5. A combination as in claim 4, wherein said tab portions are further dimensioned, configured and adapted to be folded over when said main portion is matched to said front faces and said front, to cover the top and bottom of said barrel.

6. A combination as in claim 5, wherein said main portion has left and right parallel edges, and said body member further includes kiss score lines parallel to said parallel edges for separating said body member into first and second subregions respectively including left and right wing subportions of said main portion; said first and second subportions being dimensioned, configured and adapted to be combined, with said parallel edges joined in ducktail fashion, to match and cover said back of said barrel, as well as exposed parts of said rear faces not covered by said recesses.

7. A combination as in claim 6, wherein said score lines are positioned so that said first and second subregions respectively further include left and right subportions of said tab portions; said subportions of said tab portions being dimensioned, configured and adapted to cover at least some of said exposed parts of said upper and lower edges when said first and second subportions are combined with said parallel edges joined in ducktail fashion.

8. A combination as in claim 7, wherein said kiss score lines are positioned for separating said body member also into a third subregion located intermediate said first and second subregions, said third subregion including central subportions of both said main portion and said tab portions; and said body member further including a horizontal kiss score line for separating said third subregion into upper and lower pieces; said upper and lower pieces being dimensioned, configured and adapted to be applied, respectively, between the tab portions of a first said mask folded over said top and bottom of said barrel and the ducktail-joined edges of the first and second subregions of a second said mask.

9. A method for protecting a butt hinge hanging a door on a joint using a mask;

said hinge comprising first and second flat rectangular leaf portions having upper, lower and side edges and front and rear faces; barrel portions spaced along adjacent ones of said side edges and brought into vertically aligned interdigitated positions to define a barrel having a front, a back, a top and a bottom and including a central bore therethrough; and a pin having a head with a top and inserted into said bore up to said head to join said leaf portions at said barrel in pivotal side-by-side relationship; said first leaf portion being attached within a recess formed on said door and said second leaf portion being attached within a recess formed on said joint; said recesses acting to cover opposite ones of said side edges and parts of said upper and lower edges and said rear faces;

said mask comprising a thin flexible body member having a front surface and a back surface; a coating of pressure sensitive adhesive applied to said back surface of said body member; and a protective backing sheet disposed in juxtaposition with the adhesive coating on said back surface to protect the adhesive coating while being readily peelable therefrom to expose the adhesive coating preparatory to use of said body member; said body member including a generally rectangular main portion dimensioned, configured and adapted to match and cover the contour of said front faces of said leaf portions and said front of said barrel when said door is brought into position with said first and second leaf portions in coplanar alignment; and central tab portions, extending respectively upwardly and downwardly from said main portion, and being dimensioned, configured and adapted to be folded over when said main portion is matched to said front faces and said front, to cover all exposed parts of said upper and lower edges not covered by said recesses;

and said method comprising:

opening the door to bring said first and second leaf portions into coplanar alignment;

peeling said protective backing sheet from said mask body member;

superposing said body member main portion in matched relationship over, and securing said main portion by said adhesive to, said front faces of said leaf portions and said front of said barrel, to protect said front faces and said front; and folding said upwardly and downwardly extending central tab portions respectively over, and securing said tab portions respectively by said adhesive to, said exposed parts of said upper and lower edges not covered by said recesses, to protect said exposed pats.

10. A method as in claim 9, wherein said mask is a first mask; said mask body member further includes vertical kiss score lines for separating said body member into first and second subregions respectively including left and right wing subportions of said main portion; and said method further comprises:

providing a second mask identical to said first mask;

closing said door sufficiently to make accessible said back of said barrel and exposed parts of said rear faces of said first and second leaf portions not covered by said recesses;

peeling said protective backing sheet from said second mask body member;

separating said second mask body member into said first and second subregions;

superposing said second mask first and second subregions respectively in matched relationship over, and securing said second mask first and second subregions by said adhesive to, said rear faces of said first and second leaf portions, to protect said rear faces; and securing said second mask first and second subregions by said adhesive in joined ducktail fashion over said back of said barrel, to protect said back.

11. A method as in claim 10, wherein said score lines are positioned so that said first and second subregions respectively further include left and right subportions of said tab portions; and said method further comprises:

folding said subportions of said tab portions of said second mask respectively over, and securing said second mask tab subportions by said adhesive respectively to, at least some of said exposed parts of said upper and lower edges.

12. A method as in claim 11, wherein said kiss score lines are positioned for separating said body member also into a third subregion located intermediate said first and second subregions, said third subregion including central subportions of both said main portion and said tab portions; said body member further includes a horizontal kiss score line for separating said third subregion into upper and lower pieces; and said method further comprises:

separating said third subregion of said second mask into said upper and lower pieces; and applying said separated second mask pieces respectively between said first mask folded tab portions and said second mask ducktail-joined subregions.

* * * * *